US010575621B1

(12) United States Patent
Pires et al.

(10) Patent No.: US 10,575,621 B1
(45) Date of Patent: Mar. 3, 2020

(54) COSMETIC APPLICATOR

(71) Applicant: ZEN DESIGN SOLUTIONS LIMITED, Kowloon (HK)

(72) Inventors: Leo Clifford Pires, Basking Ridge, NJ (US); Rahul Bose, New Delhi (IN); Smita Srivastava, New Delhi (IN)

(73) Assignee: ZEN DESIGN SOLUTIONS LIMITED, Kowloon (HK)

( * ) Notice: Subject to any disclaimer, the term of this patent is extended or adjusted under 35 U.S.C. 154(b) by 0 days.

(21) Appl. No.: 16/266,534

(22) Filed: Feb. 4, 2019

(51) Int. Cl.
*A45D 34/04* (2006.01)
*A45D 40/26* (2006.01)

(52) U.S. Cl.
CPC ..... *A45D 40/267* (2013.01); *A45D 34/046* (2013.01); *A45D 34/045* (2013.01); *A46B 2200/1046* (2013.01)

(58) Field of Classification Search
CPC ..... A45D 34/045; A45D 34/046
USPC ..... 401/121–130
See application file for complete search history.

(56) References Cited

U.S. PATENT DOCUMENTS 6,331,085 B1 12/2001 Schrepf et al.
7,481,591 B2 1/2009 Dumler
7,918,619 B2 4/2011 Gueret

*Primary Examiner* — David J Walczak
*Assistant Examiner* — Joshua R Wiljanen
(74) *Attorney, Agent, or Firm* — Patterson + Sheridan, LLP

(57) ABSTRACT

A cosmetic applicator for applying a cosmetic or care product includes an applicator member having a proximal portion and a distal portion. A distal portion of the applicator member is formed as an applying portion and comprises a first application side and a second application side opposite to the first application side. The applying portion includes a peripheral edge that extends around a periphery of the applying portion. The peripheral edge has a maximum thickness at a widest part of the applying portion.

8 Claims, 6 Drawing Sheets

COSMETIC APPLICATOR

BACKGROUND

Field of the Invention

Embodiments of the present disclosure generally relate to a cosmetic applicator for applying a product including a cosmetic, care or pharmaceutical product onto human skin or keratinous materials. The product includes viscous liquid or semisolid product for application on skin of face, eyes etc.

Description of the Related Art

Cosmetic applicators such as dip or wand applicators are known in the cosmetic industry. Cosmetic packages often include such applicators for dispensing a particular cosmetic contained in the package reservoir. The cosmetic applicator generally includes a stem with a cap at one end and an applicator head in the form of a brush, spatula or other applicator structure suitable for applying a cosmetic or a care product including viscous cosmetics, mascara, eye liner, lip gloss, hair color, wound care, skin care, under eye cosmetics, pharmaceutical and like products.

One such applicator is disclosed in U.S. Pat. No. 6,331,085 B1 for applying and transporting a quantity of cosmetic product to a user's skin. The applicator comprises a generally cylindrical elastomeric tip with a long axis, the tip including a distal end portion having a distal extremity with at least one material-holding concavity formed therein, and said concavity having a rim.

Another U.S. Pat. No. 7,481,591 discloses an applicator comprising a rod and an application surface formed of a plurality of cones. These cones have a certain elasticity and movability and can therefore massage the cosmetic product, which is stored between them into wrinkles and uneven areas of the skin of a user.

Another U.S. Pat. No. 7,918,619 discloses an applying portion that projects laterally from the stem and includes at least two branches of a plastic material for increasing the retention of a cosmetic product. The branches have respective ends, and the ends meet each other to define a cavity between the branches. The applying portion is able to retain a cosmetic in its cavity and therefore has increased retention.

While such applicators are generally satisfactory, there still exists a need for an applicator which is able to retain a given large quantity of a cosmetic product for application and making it possible to apply the cosmetic product with accuracy.

SUMMARY

According to an aspect of the present disclosure, there is provided a cosmetic applicator which is able to retain a given large quantity of a cosmetic product without inconveniences, such as dripping or threading.

According to an aspect of the present disclosure, the cosmetic applicator may be used to apply the product including a cosmetic or care product. The cosmetic or care product includes viscous or semi-solid cosmetics, such as lip gloss, hair color, skin care, under eye cosmetics, pharmaceutical and like products.

According to an aspect of the present disclosure, the cosmetic applicator comprises an applicator member, a stem and a cap. The applicator member is retained at a distal end of the stem for applying the cosmetic product; and the cap is retained at a proximal end of the stem.

According to an aspect of the present disclosure, the distal end of the stem includes an interior longitudinal cavity for receiving and retaining the applicator member.

According to an aspect of the present disclosure, the applicator member comprises a distal portion and a proximal portion. The proximal portion of the applicator member is formed as a shank which is configured to be received within the cavity of the stem. The distal portion of the applicator member is formed as an applying portion and is comprised of a first application side and a second application side opposite to the first application side. The distal portion of the applicator member is formed as a curved flattened applying portion.

According to another aspect of the present disclosure, the proximal portion of the applicator member is configured to be connected to an opening of a reservoir containing the cosmetic or care product, and the applicator member in such a case may have a passage for allowing flow of the cosmetic or care product from the reservoir onto the applicator member.

According to an aspect of the present disclosure, the applying portion is longer than wide. The applying portion has a width axis which is perpendicular to a central longitudinal axis of the applying portion.

According to an aspect of the present disclosure, the applying portion is wider than the stem.

According to an aspect of the present disclosure, the applying portion is off-centered with respect to a central longitudinal axis of the stem. In other words, the central longitudinal axis of the applying portion is parallel to the central longitudinal axis of the stem but does not coincide with the central longitudinal axis of the stem. In an alternate embodiment, the applying portion has a central longitudinal axis which is not parallel to the central longitudinal axis of the stem.

According to an aspect of the present disclosure, at least a portion of the applying portion is curved about an axis transverse to the central longitudinal axis of the applying portion forming a longitudinal cavity on the first application side of the applying portion. At least a portion of the second application side is convex. Further, the cavity has a cross-sectional profile whose width may vary along the central longitudinal axis of the applying portion. The cavity serves to retain the cosmetic product on the first application side.

According to a preferred embodiment of the present disclosure, at least a portion of the applying portion is curved about an axis transverse to the central longitudinal axis of the applying portion forming a longitudinal concavity on the first application side of the applying portion. At least a portion of the first application side of the applying portion is concave and at least a portion of the second application side is convex. The longitudinal concavity of the first application side is curved in the width axis. The concavity has a generally U-like transverse cross-sectional profile whose width may vary along the longitudinal axis of the applying portion. The concavity serves to retain a cosmetic product on the first application side.

According to yet another aspect of the present disclosure, the longitudinal concavity of the applying portion extends on the first application side from a proximal end of the applying portion to a distal end or a tip of the applying portion.

According to yet another aspect of the present disclosure, the applying portion may be covered with application elements like flocking. The flocking finish to the surface of applying portion may be achieved by an appropriately chosen known technique, such as electrostatic flocking.

According to yet another aspect the present disclosure, the applying portion has at least one widest part when viewed from the front. The at least one widest part is located at any length of the applying portion. Preferably, the widest part is located approximately at half a length of the applying portion. In other embodiments, the widest part may extend over a certain portion of the length of the applying portion. The widest part is at a position distant from the tip or the distal end of the applying portion. The applying portion gradually decreases in width from the widest part to the proximal end of the applying portion where the applying portion and the stem are connected to each other. The width of the applying portion and the width (i.e., the diameter) of the stem may be substantially equal where the applying portion and the stem are connected to each other. The applying portion also gradually decreases in width from the widest part to the tip or the distal end. In short, the applying portion has its width gradually increased from the tip to the widest part and gradually decreased from the widest part to the proximal end. The tip may or may not be a sharply pointed. The distal end of the applying portion is formed as a sharply pointed tip.

According to yet another aspect the present disclosure, the first application side forming the longitudinal concavity of the applying portion includes a molded continuous centerline rib which extends along the central longitudinal axis of the applying portion from the proximal end of the applying portion to up to a portion of a length of the applying portion. Preferably, the centerline rib extends to up to half of the length of the applying portion or to the widest part of the applying portion. The centerline rib has a width which gradually decreases along the central longitudinal axis of the applying portion from the proximal end of the applying portion towards the distal end of the applying portion. The centerline rib provides a structural strength to the applying portion so that the applying portion does not bend away from the central longitudinal axis of the applying portion during wiping action by a wiper on withdrawal of the applicator member from a receptacle. This means that the position of the tip of the applying portion relative to the stem does not change during wiping.

According to another aspect of the present disclosure the second application side having a convex portion is smooth and even.

According to another aspect of the present disclosure, the applying portion includes a peripheral edge that extends around a periphery of the applying portion. The peripheral edge of the applying portion has a thickness. As used herein, the term "thickness" is the distance measured between the first application side and the second application side. The thickness of the peripheral edge may vary along the central longitudinal axis of the applying portion. The peripheral edge has a maximum thickness at the widest part of the applying portion. Alternately, the peripheral edge has a maximum thickness along a portion of the widest part extending over a portion of the length of the applying portion. The peripheral edge is curved and does not possess any sharp points so as to provide a softer feel to the user during application. Sharp peripheral edge is not preferable as a sharp edge is uncomfortable and can cause scraping. The greater thickness at the peripheral edge produces an advantageous effect that dripping and threading of the cosmetic product is effectively prevented.

According to yet another aspect of the present disclosure, in a side view of the applying portion, the peripheral edge, along a lateral side of the applying portion, has a curvature comprising a concave curve followed by a convex curve extending from the proximal end to the distal end of the applying portion. The convex curve extends along more than half of the length of the applying portion, more preferably more than 60% of the length of the applying portion.

According to yet another aspect of the present disclosure, the applying portion may be covered in flocking. In applying the cosmetic product, the applying portion is able to retain an increased quantity of the cosmetic product because of the synergistic effect brought about by the combination of the curvedness of the applying portion and the effect of the flocking finish. As a result, the number of the applying operations is reduced. To cover the applying portion in flocking produces another advantage that the applying portion feels soft when applied to the lips or any other area of skin of the user.

Briefly, the fibers for flocking which may be of any commonly used material, such as nylon, polyester, or any natural fiber are applied with an adhesive, such as an epoxy, to the surface to be flocked. Preferably, the flocking process takes place in an electrostatic field, which results in the proper orientation of the fibers. The flock on the applying portion provides a convenient "reservoir" which can hold a small amount of cosmetic product adequate for one or two applications. According to yet another aspect of the present disclosure, the cosmetic applicator of the present disclosure is to be used in a cosmetic packaging comprising a receptacle for holding a cosmetic product and said cosmetic applicator. The cap of the cosmetic applicator includes threads on its inner surface which can be screwed onto threads, formed on a neck of the receptacle for closing the receptacle in a leak tight manner. The receptacle includes a wiper in the neck for wiping off excess product from the cosmetic applicator.

After the applying portion passes through the wiper, there is a very little retention of the cosmetic product on the second application side as compared to the first application side which retains a large quantity of the cosmetic product because of the concavity.

According to yet another aspect of the present disclosure, the stem can be of a longitudinal axis that is rectilinear as shown, or, in a variant embodiment, it could be curved. The stem may have a cross-section that is circular, but it is not beyond the ambit of the present disclosure for this to be otherwise, in particular when the cross-section of the stem can be oval, elliptical, or polygonal, e.g. square, rectangular, or triangular. The stem can be solid or hollow.

When the stem is not of circular cross-section, the cap can possibly be fastened on the receptacle by snap-fastening or by some other means, without turning relative to said receptacle. The wiper can thus present a non-circular wiper orifice of section that is complementary to the section of the stem.

In alternate embodiments, the applicator member and the stem may be integrally formed of the same material or may be formed as separate members that are connected to each other by any suitable fixing means known in the art. For example, the applicator member can be fastened to the stem by adhesive, by heat-sealing, by force-fitting, by snap-fastening, by crimping, or by screw-fastening. In a variant embodiment, the applicator member is made integrally with the stem, e.g. from the same material or from different materials, e.g. by dual-injection.

According to an aspect of the present disclosure, at least a part and preferably all of the applicator member can be made by molding, e.g. by injection-molding, e.g. in a material selected from the following list: thermoplastic materials; elastomers; thermoplastic elastomers; thermoplastic elastomer polyester such as HYTREL®, for example; nitrile rubber; silicone rubber; ethylene-propylene terpolymer rubber (EPDM); styrene-ethylene-butylene-styrene (SEBS); styrene-isoprene-styrene (SIS); polyurethane (PU); ethyl vinyl acetate (EVA); polyvinyl chloride (PVC); polyethylene (PE); polyethylene terephthalate (PET); polypropylene (PP); this list not being limiting.

According to an aspect of the present disclosure, the applicator member can be made, at least in part, from a material that is more flexible than a material from which the stem is made.

Although the present disclosure herein has been described with reference to particular embodiments, it is to be understood that these embodiments are merely illustrative of the principles and applications of the present disclosure. It is therefore to be understood that numerous modifications may be made to the illustrative embodiments and that other arrangements may be devised without departing from the spirit and scope of the present disclosure.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings.

Figure 1:
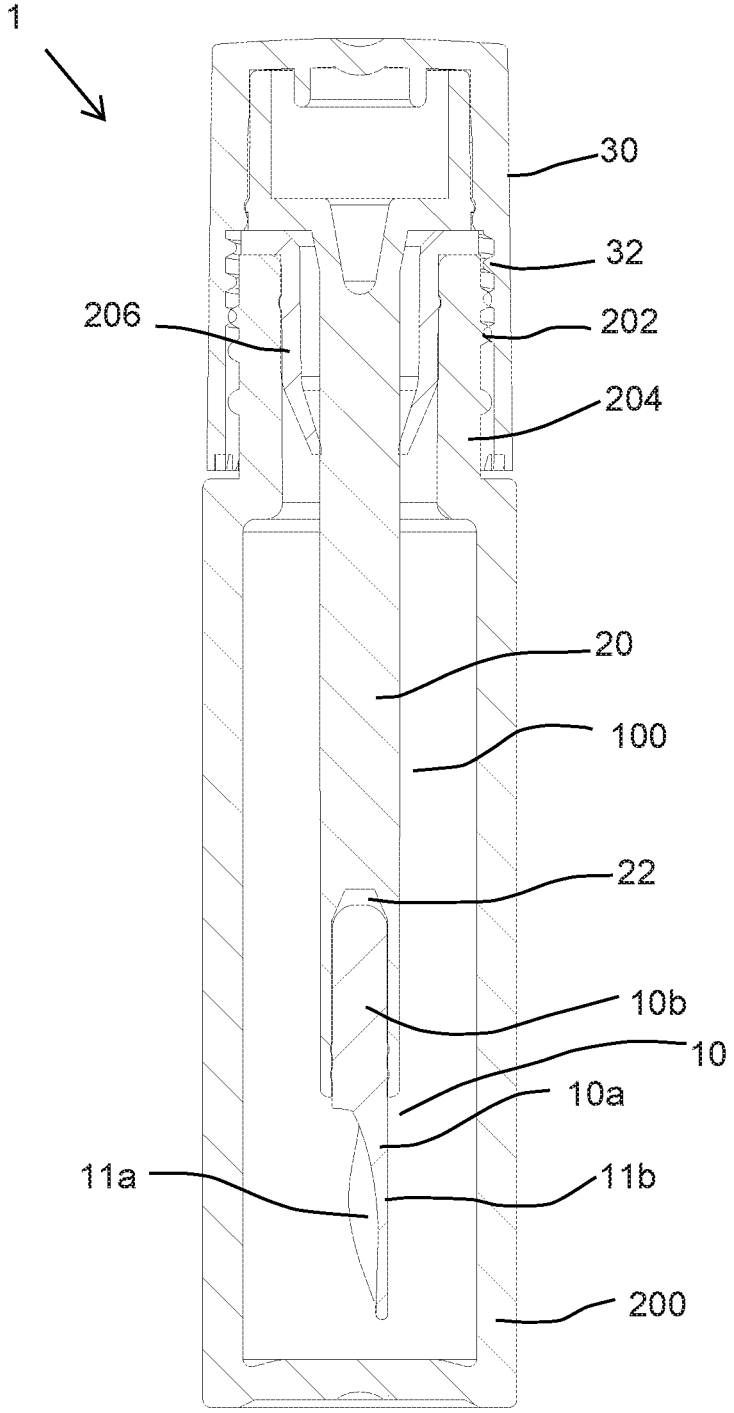
FIG. 1 shows a longitudinal sectional view of a cosmetic package comprising a cosmetic applicator of present disclosure.

To facilitate understanding, identical reference numerals have been used, where possible, to designate identical elements that are common to the figures. It is to be noted, however, that the appended drawings illustrate only typical embodiments of this disclosure and are therefore not to be considered limiting of its scope, for the disclosure may admit to other equally effective embodiments.

DETAILED DESCRIPTION

Throughout this specification, the terms "comprise," "comprises," "comprising" and the like, shall consistently mean that a collection of objects is not limited to those objects specifically recited.

FIG. 1 illustrates a longitudinal sectional view of a cosmetic package 1 according to present disclosure. The cosmetic package 1 comprises a receptacle 200 for holding a cosmetic product (not shown) and a cosmetic applicator 100. The cosmetic applicator 100 comprises an applicator member 10, a stem 20 and a cap 30. The cap 30 of the applicator 100 has threads 32 on its inner surface which can be screwed onto threads 202, formed on an outer surface of a neck 204 of the receptacle 200 for closing the receptacle 200 in a leak tight manner.

According to alternate embodiments, the neck 204 and the cap 30 can be engaged by other engagement means known in the art like snap fit, j-lock etc.

Inserted in the neck 204 of the receptacle 200 is a wiper 206 for wiping off excess product from the applicator 100.

Figure 2:
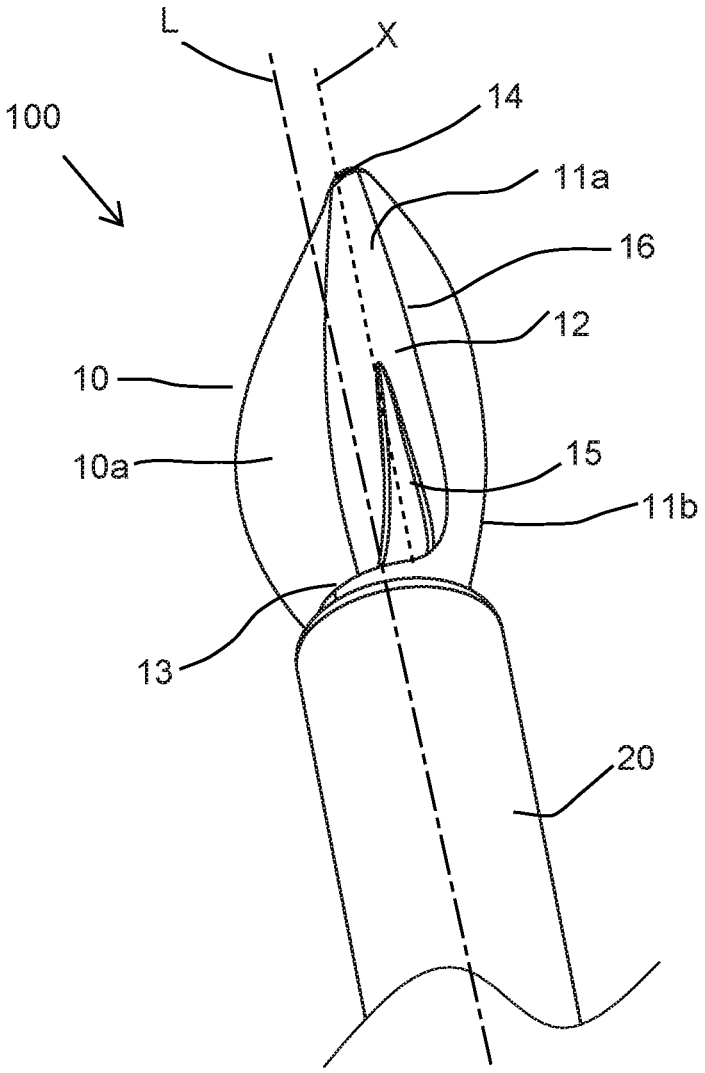
FIG. 2 shows an enlarged isometric view of a portion of the cosmetic applicator of FIG. 1.

FIG. 2 illustrates an enlarged isometric view of a portion of the cosmetic applicator 100, in which the applicator member 10 is depicted upside down relative to that in FIG. 1. The cosmetic applicator 100 may be used to apply the product (not shown) including a cosmetic or care product. The cosmetic or care product includes viscous or semi-solid cosmetics, such as lip gloss, hair color, skin care, under eye cosmetics, pharmaceutical and like products.

As shown in FIGS. 1-5, the cosmetic applicator 100 comprises the applicator member 10 retained at a distal end of the stem 20 for applying the cosmetic product; and the cap 30 attached at a proximal end of the stem 20. The distal end of the stem 20 includes an interior longitudinal cavity 22 for receiving and retaining the applicator member 10. The stem 20 can have a longitudinal axis that is rectilinear as shown, or, in a variant, it could be curved.

In the embodiment described the stem 20 presents a cross-section that is circular, but it is not beyond the ambit of the present disclosure for this to be otherwise, in particular when the cross-section of the stem 20 is oval, elliptical or polygonal, e.g. square, rectangular or triangular. The stem 20 can be solid or hollow.

When the stem 20 is not of circular cross-section, the cap 30 can possibly by fastened on the receptacle 200 by snap-fastening or by some other means, without turning relative to said receptacle 200. The wiper 206 can thus present a non-circular wiper orifice of section that is complementary to the section of the stem 20.

Referring to FIG. 1, the applicator member 10 comprises a distal portion 10*a* and a proximal portion 10*b*. The proximal portion 10*b* of the applicator member 10 is formed as a shank 10*b* which is configured to be received within the cavity 22 of the stem 20. In alternate embodiments, the applicator member 10 and the stem 20 may be integrally formed of the same material or may be formed as separate members that are connected to each other by any suitable fixing means known in the art. For example, the applicator member 10 can be fastened to the stem 20 by adhesive, by heat-sealing, by force-fitting, by snap-fastening, by crimping, or by screw-fastening. In a variant embodiment, the applicator member 10 is made integrally with the stem 20, e.g. from the same material or from different materials, e.g. by dual-injection molding.

In other alternate embodiments not shown in the drawings, the proximal portion of the applicator member 10 may be configured to be connected to an opening of a reservoir containing the cosmetic or care product, and the applicator member 10 in such a case may have a passage for allowing flow of the cosmetic or care product from the reservoir onto the applicator member 10.

The distal portion 10*a* of the applicator member 10 is formed as an applying portion and is comprised of a first application side 11*a* and a second application side 11*b* opposite to the first application side 11*a*. The distal portion 10*a* of the applicator member is formed as a curved flattened applying portion.

The applicator member 10 can be made, at least in part, from a material that is more flexible than a material from which the stem 20 is made.

At least a part and preferably all of the applicator member 10 can be made by molding, e.g. by injection-molding, e.g. in a material selected from the following list: thermoplastic materials; elastomers; thermoplastic elastomers; thermoplastic elastomer polyester such as HYTREL®, for example; nitrile rubber; silicone rubber; ethylene-propylene terpolymer rubber (EPDM); styrene-ethylene-butylene-styrene (SEBS); styrene-isoprene-styrene (SIS); polyurethane (PU); ethyl vinyl acetate (EVA); polyvinyl chloride (PVC); polyethylene (PE); polyethylene terephthalate (PET); polypropylene (PP); this list not being limiting.

Figure 5:
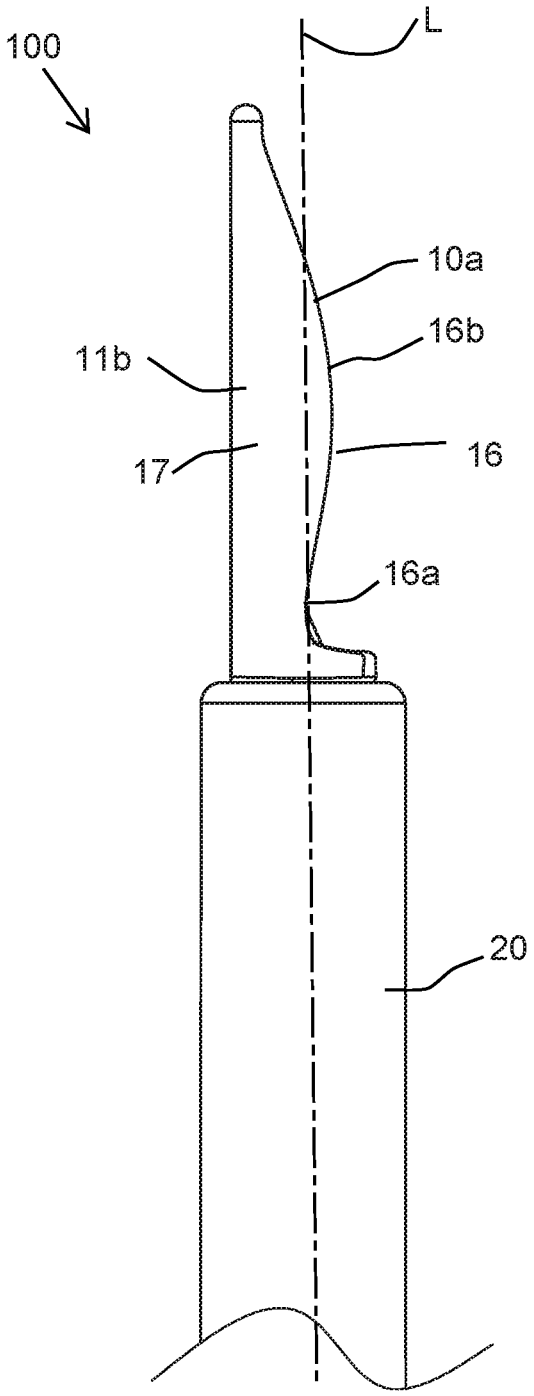
FIG. 5 shows a side view of the cosmetic applicator of FIG. 2.
Figure 6:
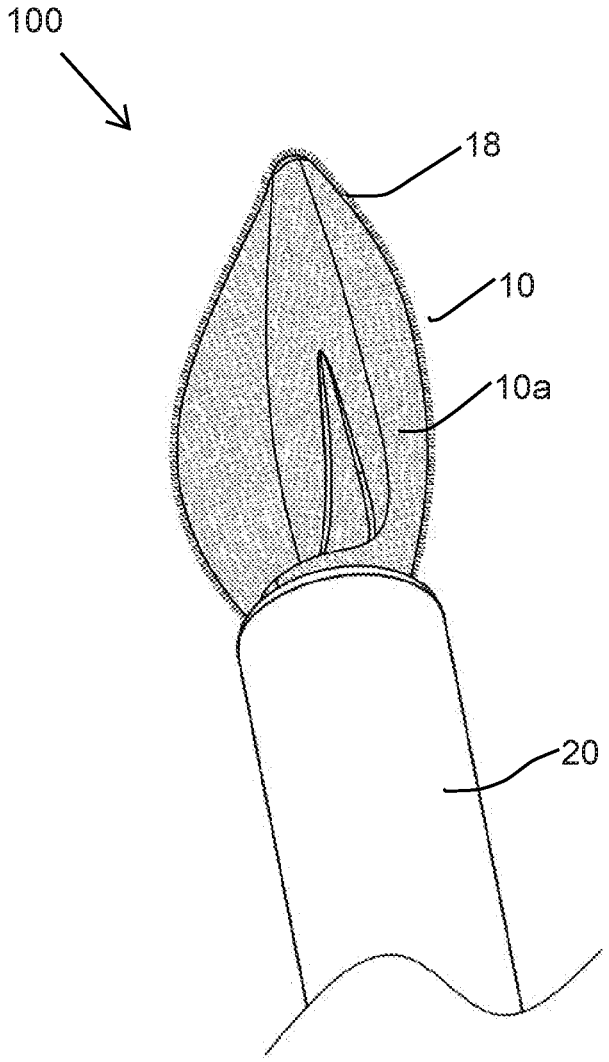
FIG. 6 shows the cosmetic applicator of FIG. 2 with flocking on an applying portion of the cosmetic applicator of FIG. 2.

As shown in FIG. 6, the applying portion 10*a* is covered with application elements 18 which in this case is flocked fibers 18. Briefly, the fibers 18 for flocking which may be of any commonly used material, such as nylon, polyester or any natural fiber are applied with an adhesive, such as an epoxy, to the surface to be flocked. The flocking finish to the surface of applying portion 10*a* may be achieved by an appropriately chosen known technique, such as electrostatic flocking. The applying portion 10*a* before being flocked is smooth on its entire surface as shown in FIGS. 1-5. That is, the applying portion 10*a* before being flocked has no surface textures, such as a wrinkle finish or a matte finish, over the entire surface thereof. To put it another way, the applying portion 10*a* before being flocked is smooth and slippery. Preferably, the flocking process takes place in an electrostatic field, which results in the proper orientation of the fibers. The flock on the applying portion 10*a* provides a convenient "reservoir" which can hold a small amount of the cosmetic product adequate for one or two applications. In alternate embodiments, the application elements 18 may include injection molded fibers, projections or grooves which are capable of holding the cosmetic product.

As shown in FIGS. 1-5, the applying portion 10*a* of the applicator member 10 is wider than the stem 20. The applying portion 10*a* is longer than wide, having a central longitudinal axis X which is parallel to a central longitudinal axis L of the stem 20 but does not coincide with the central longitudinal axis L of the stem 20 (as shown in FIG. 2). In other words, the applying portion 10*a* is off-centered with respect to the central longitudinal axis L of the stem 20. In other alternate embodiments, the longitudinal axis X of the applying portion 10*a* may not be parallel to the central longitudinal axis L of the stem 20.

Further, the applying portion 10*a* has a width axis Y perpendicular to the central longitudinal axis X. As used herein, the term "width" is defined to be a length in the axis Y in FIG. 3A. The applying portion 10*a* is curved about the axis Y transverse to the central longitudinal axis X of the applying portion 10*a* to form a longitudinal cavity which in present case is a concavity on the first application side 11*a* of the applying portion 10*a*. The first application side 11*a* is thus concave and the second application side 11*b* is convex with respect to the axis Y. The first application side 11*a* has the longitudinal concavity 12 which is curved along the width axis Y. The longitudinal concavity 12 has a generally U-like transverse cross-sectional profile whose width varies along the central longitudinal axis X. The concavity 12 serves to retain a cosmetic or a care product on the first application side 11*a*. The longitudinal concavity 12 extends on the first side 11*a* from a proximal end 13 of applying portion 10*a* to a distal end 14 or a tip 14 of the applying portion 10*a*.

In applying the cosmetic product, the applying portion 10*a* is able to retain an increased quantity of the cosmetic product because of the synergistic effect brought about by the combination of the curvedness and the effect of the flocking finish. As a result, the number of the applying operations is reduced. To cover the applying portion in flocking produces another advantage that the applying portion feels soft when applied to the lips or any other area of skin of the user.

Figure 3A:
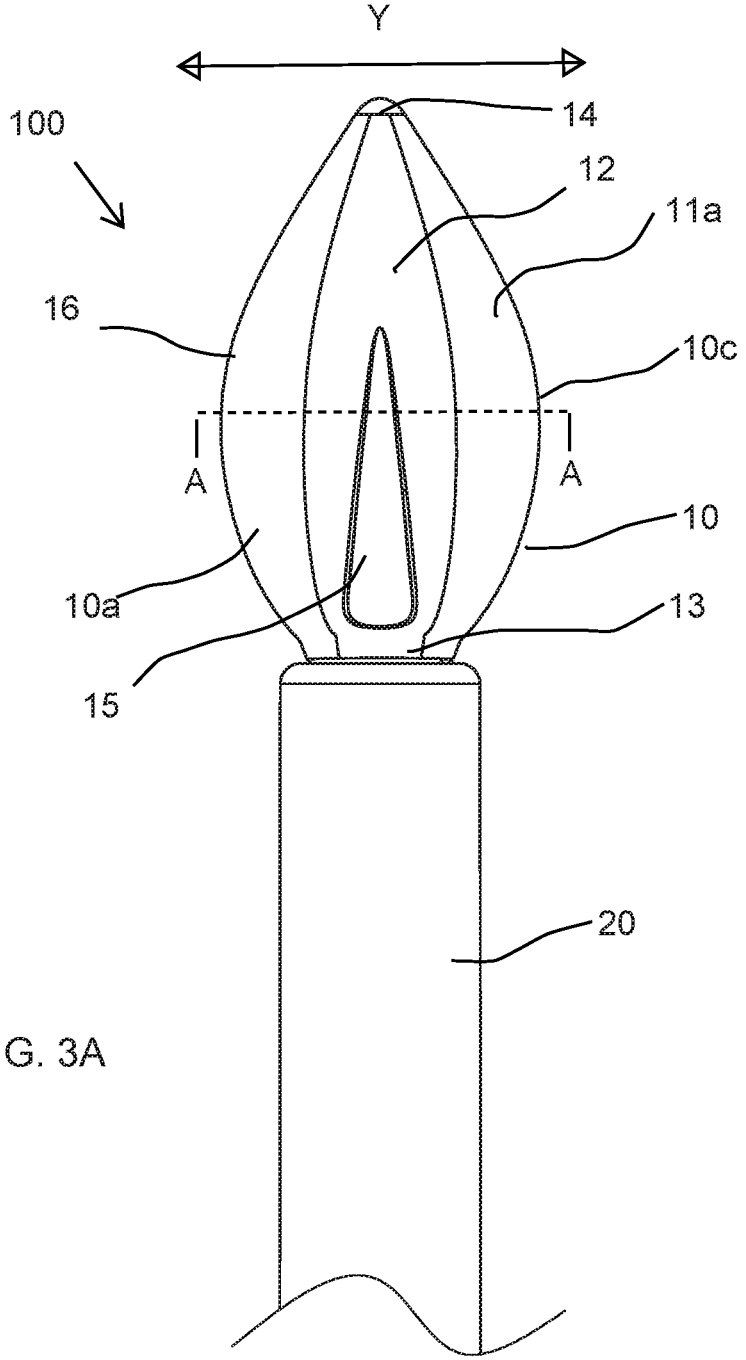
FIG. 3A shows a front view of the cosmetic applicator of FIG. 2.
Figure 3B:
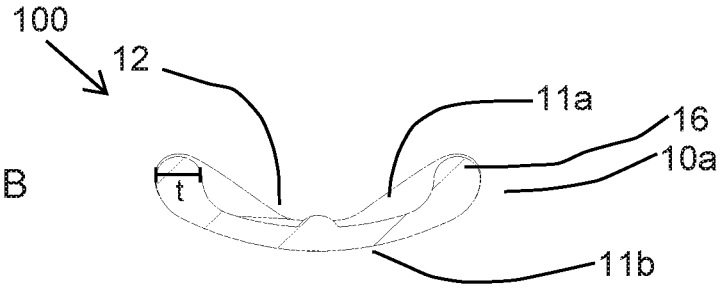
FIG. 3B shows a cross-sectional view along axis A-A of the cosmetic applicator of FIG. 3A.
Figure 4:
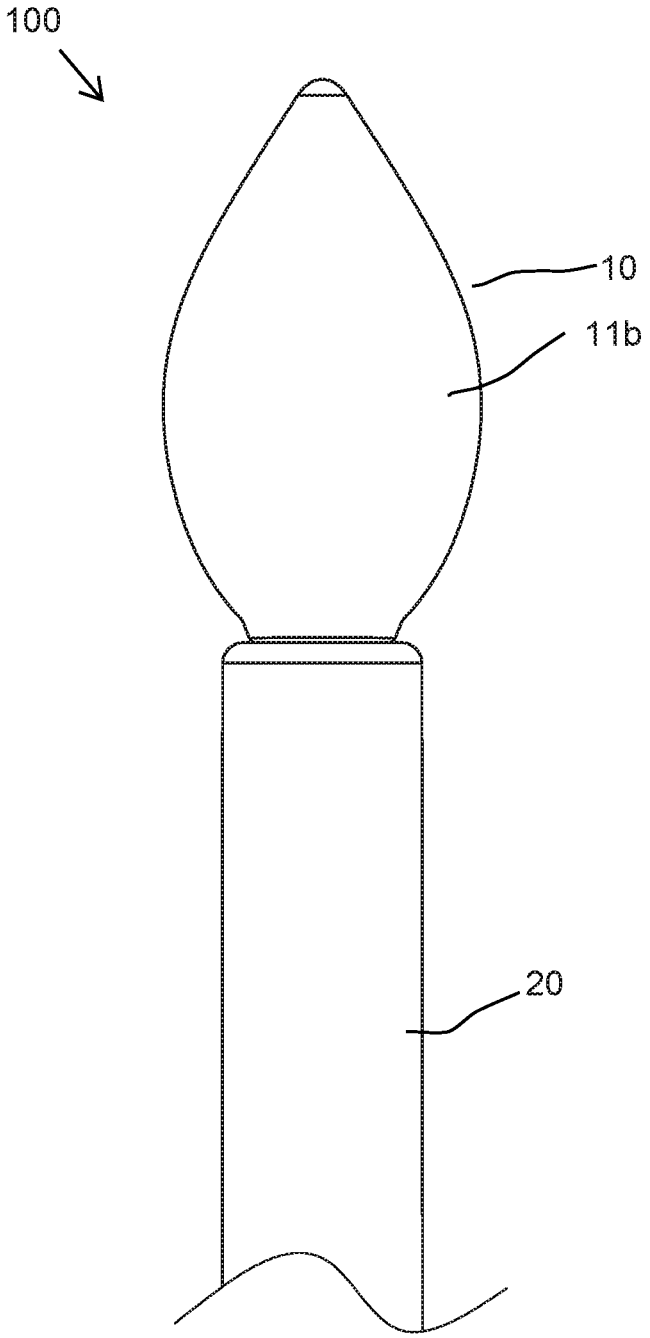
FIG. 4 shows a rear view of the cosmetic applicator of FIG. 2.

As shown in FIG. 3A, the applying portion 10*a* has a widest part 10*c* when viewed from the front. The widest part 10*c* may be present at any portion of a length of the applying portion 10*a*. As shown in FIG. 3A, the applying portion 10*a* has a widest part 10*c* located approximately at half of the length of the applying portion 10*a*. In alternate embodiment, the widest part 10*c* may extend over a certain portion of the length of the applying portion 10*a*.

Further, the applying portion 10*a* gradually decreases in width from the widest part 10*c* to the proximal end 13 where the applying portion 10*a* and the stem 20 are connected to each other. The width of the applying portion 10*a* and the width (i.e., the diameter) of the stem 20 are substantially equal where the applying portion 10*a* and the stem 20 are connected to each other. The widest part 10*c* is at a position distant from the tip 14 or the distal end 14 of the applying portion 10*a*. The applying portion 10*a* also gradually decreases in width from the widest part 10*c* to the tip 14. The tip 14 is preferably a sharply pointed. The sharply pointed tip 14 helps in delicate and fine application of the cosmetic product to, for example, the ends of lips of the user. In short, the applying portion 10*a* has its width gradually increased from the tip 14 to the widest part 10*c* and gradually decreased from the widest part 10*c* to the proximal end 13.

As shown in FIGS. 2 & 3A, the concavity 12 of the applying portion 10*a* includes a molded continuous centerline rib 15 which extends along the central longitudinal axis X of the applying portion 10*a* from the proximal end 13 of the applying portion 10*a* to up to a portion of the length of the applying portion 10*a*, preferably up to half of the length of the applying portion 10*a*. The centerline rib 15 has a width along Y axis which gradually decreases along the central longitudinal axis X from the proximal end 13 towards the distal end 14. The centerline rib 15 provides a structural strength to the applying portion 10*a* so that the applying portion 10*a* does not bend away from the longitudinal axis X during wiping by the wiper 206 on withdrawal of the applicator member 10 from the receptacle 200. In other words, the centerline rib 15 hinders the deformation of the applying portion 10*a* away from the central longitudinal axis X. This means that the position of the tip 14 of the applying portion 10*a* relative to the stem 20 does not change during wiping.

After the applying portion 10 passes through the wiper 206, there is very little retention of the cosmetic product on the second application side 11*b* as compared to the first application side 11*a* which retains a large quantity of the cosmetic product because of the concavity 12.

According to another aspect of the present disclosure the second application side 11*b* having a convex portion is smooth and even.

According to another aspect of the present disclosure, the applying portion 10*a* includes a peripheral edge 16 (refer to FIGS. 2 to 6) that extends around the periphery of the applying portion 10*a*. The peripheral edge 16 of the applying portion 10*a* has a thickness "t". As used herein, the term "thickness" is the distance measured between the first application side 11*a* and the second application side 11*b*. The thickness of the peripheral edge 16 may vary along the central longitudinal axis X of the applying portion 10*a*. The peripheral edge 16 has a maximum thickness "t" at the widest part 10*c* of the applying portion 10*a* as shown in FIG. 38, in a cross-section view taken along the width axis Y. Alternately, the peripheral edge 16 has a maximum thickness "t" along a portion of the widest part 10*c* extending over a portion of the length of the applying portion 10*a*. The peripheral edge 16 is curved and does not possess any sharp points so as to provide a softer feel to the user during application. Sharp peripheral edge is not preferable as a sharp edge is uncomfortable and can cause scraping. The greater thickness at the peripheral edge 16 produces an advantageous effect that dripping and threading of the cosmetic product is effectively prevented.

According to another aspect of the present disclosure, in side view of the applying portion 10*a*, as seen in FIG. 5, the peripheral edge 16 along a lateral side 17 of the applying portion 10*a* has a curvature comprising a concave curve 16*a* followed by a convex curve 16*b* extending from the proximal end portion to the distal end of the applying portion 10*a*. The convex curve 16*b* extends along more than half of the length of the applying portion 10*a*, more preferably more than 60% of the length of the applying portion 10*a*.

The present embodiment provides the advantageous effect that excess cosmetic product is wiped off from the applying portion 10*a* by the wiper 206 to leave an adequate amount of the cosmetic product as retained on the first side 11*a* of the applying portion 10*a*. In addition to this effect, there is obtained another advantage that dripping or threading of the cosmetic product is prevented.

Although the present disclosure herein has been described with reference to particular embodiments, it is to be understood that these embodiments are merely illustrative of the principles and applications of the present disclosure. It is therefore to be understood that numerous modifications may be made to the illustrative embodiments and that other arrangements may be devised without departing from the spirit and scope of the present disclosure and the scope thereof is determined by the claims that follow.

What is claimed is:

1. An applicator for applying a cosmetic or a care product, the applicator comprising:

an applicator member retained at a distal end of a stem;

the applicator member comprising a distal portion and a proximal portion;

the proximal portion of the applicator member is configured to be received within a cavity of the stem;

the distal portion of the applicator member is formed as a curved flattened applying portion;

wherein the applying portion is off-centered with respect to a central longitudinal axis of the stem;

wherein the applying portion is longer than wide;

wherein a distal end of the applying portion is formed as a sharply pointed tip;

wherein a width of the applying portion gradually increases from the distal end of the applying portion to a widest part of the applying portion and gradually decreases from the widest part of the applying portion to a proximal end of the applying portion;

wherein the applying portion includes a peripheral edge that extends around a periphery of the applying portion;

wherein the peripheral edge has a maximum thickness at the widest part of the applying portion;

wherein the maximum thickness of the peripheral edge is greater than a thickness along a central longitudinal axis of the applying portion;

wherein the applying portion comprises of a first application side and a second application side opposite to the first application side;

wherein at least a portion of the first application side is concave and at least a portion of the second application side is convex;

wherein the first application side forms a longitudinal cavity extending along a central longitudinal axis of the applying portion;

wherein a width of the longitudinal cavity varies along the central longitudinal axis of the applying portion;

wherein the first application side forming the longitudinal cavity includes a molded continuous centerline rib which extends along the central longitudinal axis of the applying portion from a proximal end of the applying portion to up to a portion of a length of the applying portion; and wherein the second application side having a convex portion is smooth and even.

2. An applicator according to claim 1, wherein the applying portion is wider than the stem.

3. An applicator according to claim 1, wherein the applying portion is covered with flocked fibers.

4. An applicator according to claim 1, wherein the widest part of the applying portion is located at half of the length of the applying portion.

5. An applicator according to claim 1, wherein the peripheral edge along a lateral side of the applying portion has a curvature comprising a concave curve followed by a convex curve extending from the proximal end portion to a distal end of the applying portion.

6. An applicator according to claim 1, wherein the centerline rib extends along the central longitudinal axis of the applying portion from the proximal end of the applying portion to up to half of the length of the applying portion.

7. An applicator according to claim 1, wherein the centerline rib extends along the central longitudinal axis of the applying portion from the proximal end of the applying portion to up to the widest part of the applying portion.

8. An applicator according to claim 1, wherein the centerline rib has a width which gradually decreases along the central longitudinal axis of the applying portion from the proximal end of the applying portion towards a distal end of the applying portion.

* * * * *